US005845420A

United States Patent [19]

Buccianti et al.

[11] Patent Number: 5,845,420

[45] Date of Patent: Dec. 8, 1998

[54] SHOE SOLE WITH A SUSTAINING STRUCTURE

[75] Inventors: Mario Buccianti, Avenza; Pasquale Neri, Segromigno Monte, both of Italy

[73] Assignee: DIEFFEGI S.r.L., Lucca, Italy

[21] Appl. No.: 936,006

[22] Filed: Sep. 23, 1997

[30] Foreign Application Priority Data

Jan. 31, 1997 [IT] Italy ..... T0 97/000021 U

[51] Int. Cl.[6] ..... A43B 7/14; A43B 13/14

[52] U.S. Cl. ..... 36/91; 36/25 R

[58] Field of Search ..... 36/91, 25, 28, 36/31, 142

[56] References Cited

U.S. PATENT DOCUMENTS 4,494,320 1/1985 Davis .
5,440,826 8/1995 Whatley .
5,595,004 1/1997 Lyden et al. .

FOREIGN PATENT DOCUMENTS 0 471 447 A 2/1992 European Pat. Off. .
0560698 A 9/1993 European Pat. Off. .
WO 9639061 A 12/1996 WIPO .

*Primary Examiner*—Ted Kavanaugh
*Attorney, Agent, or Firm*—Merchant, Gould, Smith, Edell, Welter & Schmidt

[57] ABSTRACT

There is disclosed a shoe sole formed by moulding an elastomeric-like material and provided with an insert of a material having different consistence and stiffness. The insert consists of an X-shaped frame (5) buried in the sole (2) transversally with respect to the lengthwise axis of the shoe at the zone under the arch of the foot. The branch portions (8, 9) forming the X-shaped frame have their ends (7) on either side of the shoe connected therebetween by integrally formed reverse-U-shaped portions (10, 11).

13 Claims, 1 Drawing Sheet

FIG. 1
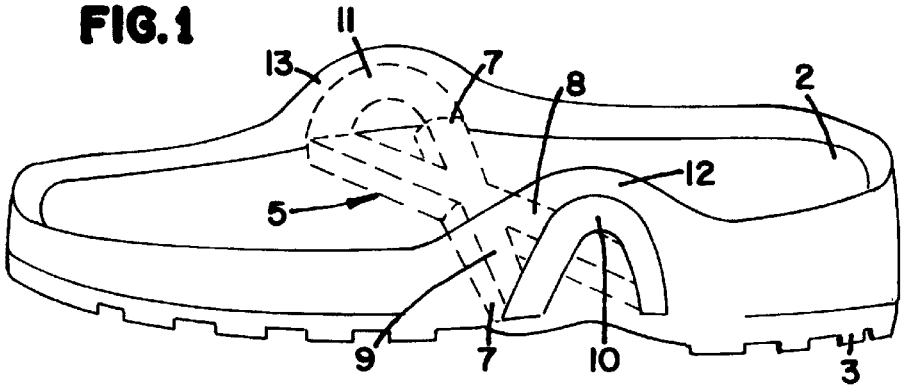
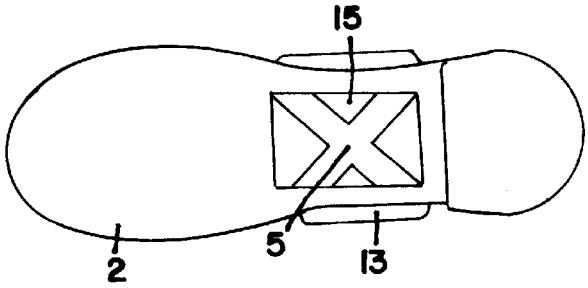
FIG. 2
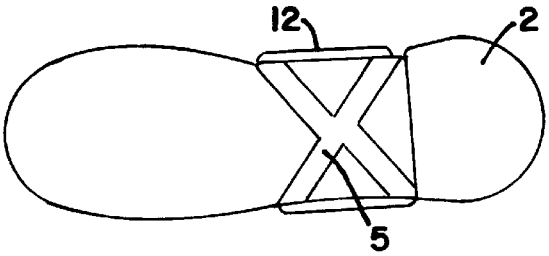
FIG. 3
FIG. 4
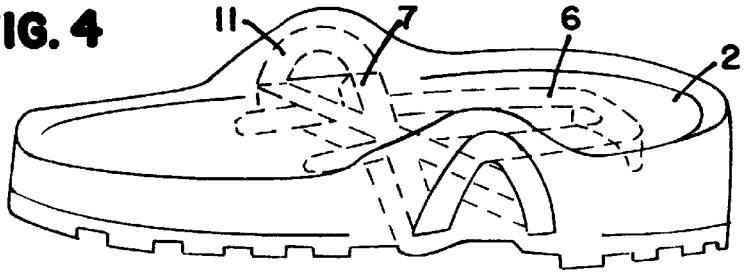

SHOE SOLE WITH A SUSTAINING STRUCTURE

Description

The present invention relates to a shoe sole fitted with an insert for varying its resistance and the response to stresses.

There are presently known shoe soles, particularly for sports shoes, which have inserts of different rigidity, usually of plastic or elastomeric material, for varying the elasticity features, the compression and torsion resistance, etc., of the sole.

Particularly, the above inserts are generally fitted in the heel of the shoe, that is of primary importance in determining the behaviour of the shoe being worn. However, this kind of shoe with inserts cannot contrast torsion about the lengthwise axis of the shoe, and therefore in some cases cannot prevent twists to the foot. Moreover, said inserts cannot stop the sole from collapsing, particularly the part underneath the arch of the foot, nor can they provide the resistance to torsional stress required according to the use for which the shoe is intended and for which it has been designed.

It is an object of the present invention to overcome the above discussed prior art drawbacks.

To meet this object, the invention provides a shoe sole formed by moulding an elastomeric-like material and provided with an insert of a material having different consistence and stiffness, wherein said insert consists of a substantially X-shaped frame buried in the sole transversally with respect to the lengthwise axis of the shoe at the zone under the arch of the foot, the branch portions forming said X-shaped frame having their ends on either side of the shoe connected therebetween by integrally formed reverse-U-shaped portions.

In order that the present invention may be well understood there will now be described a few preferred embodiments thereof, given by way of example, reference being made to the accompanying drawings, in which:

FIG. 1 is a perspective view of a shoe sole according to the present invention, including a frame partially shown in phantom line;

FIG. 2 is a bottom view of a first variant embodiment of the shoe sole of this invention;

FIG. 3 is a bottom view of a second variant of the sole of this invention; and FIG. 4 is a perspective view of a variant to the embodiment of FIG. 1.

Referring now to FIG. 1 of the drawings, numeral 2 designates the sole of a shoe, in this example a sports shoe. The sole is made by moulding a rubber-like or elastomeric material so as to form a pattern 3 in relief on its bottom surface for contacting the ground.

In its central part located under the arch of the foot the sole is provided with an insert consisting of a substantially X-shaped frame 5. In a different embodiment, as shown in FIG. 4, the frame 5 is provided with a substantially U-shaped additional reinforcing appendix 6 disposed along the main, lengthwise axis of the sole and connected to the frame 5. It is understood that the shape of the reinforcing structure 6 is not limiting, and that a number of modified shapes will be apparent to those skilled in the art in view of these examples. The frame 5 is buried in the sole, which can be made of rubber, para rubber, synthetic rubber or equivalent materials. The frame 5 is arranged transversally with respect to the lengthwise main axis of the shoe such that the end portions of the branches 8 and 9 forming the X reach the outer surface at either side of the sole 2.

The ends 7 of branch portions 8, 9 on either side of the shoe are connected therebetween by two reverse-U-shaped portions 10, 11 integral with and perpendicular to said branches 8, 9, so as to form reinforcement parts at the sides of the sole. At the U-shaped portions 10, 11, the sole forms two side relieves 12, 13, which rest against the inner sides of the U-shaped portions without including them, to provide protection and dampening action to the sides of the foot. Therefore, the two U-shaped portions are external to the sole and visible.

Obviously, such a sole fitted with the above described frame is more torsion-resistant owing to the two side U-shaped portions. Further, the sole supports the arch of the foot by means of the X-shaped part of the frame. Such a sole will so allow the movement required while controlling the extent thereof in accordance with the kind of shoe.

In a different embodiment, shown in FIG. 2, for aesthetic reasons a portion 15 of the sole at the central part of the X-shaped frame is made of a transparent material, so that the frame can be seen when the shoe is lifted up.

In a third embodiment of the invention, as shown in FIG. 3, also the X-shaped part of the frame 5 extends underneath the sole 1. In this way the whole X-shaped part of the frame is visible from the outside, without the risk of breaking a thin part of the sole underneath it.

In a further embodiment of the invention (not shown), one or both of the side U-shaped portions 10, 11 can be completely buried in the side relieves 12, 13 of the sole, while still being visible form the outside. This embodiment, however, is not suited for trekking or running.

It is to be understood that the shape of the insert and the materials for constructing the sole and its insert can be modified within the scope of this invention, as defined by the appended claims.

What is claimed is:

1. A shoe sole formed by moulding an elastomeric-like material and provided with an insert of a material having different consistence and stiffness, wherein said insert consists of a substantially X-shaped frame buried in said sole transversally with respect to the lengthwise axis of the shoe at the zone under the arch of the foot, said X-shaped frame being formed by branch portions having their ends on either side of the shoe connected therebetween by integrally formed U-shaped portions.

2. A shoe sole as claimed in claim 1, wherein said frame is provided with a reinforcement appendix extending in the lengthwise direction of the sole.

3. A shoe sole as claimed in claim 2, wherein said appendix is U-shaped.

4. A shoe sole as claimed in claim 1, wherein said U-shaped portions are external to the sole.

5. A shoe sole as claimed in claim 1, wherein said U-shaped portions are substantially perpendicular to said branch portions.

6. A shoe sole as claimed in claim 1, characterised in comprising side relieves at said U-shaped portions.

7. A shoe sole as claimed in claim 6, wherein said relieves rest on the inner face of said U-shaped portions.

8. A shoe sole as claimed in claim 6, wherein said side relieves include said U-shaped portions.

9. A shoe sole as claimed in claim 6, wherein said side relieves include one of said U-shaped portions.

10. A shoe sole as claimed in claim 6, wherein said relieves are made of a transparent or semi-transparent material.

11. A shoe sole as claimed in claim 6, wherein said relieves are made of a non-transparent nor semi-transparent material.

12. A shoe sole as claimed in claim 1, characterised in comprising a central portion of transparent material covering said frame.

13. A shoe sole as claimed in claim 1, wherein said frame protrudes from the lower part of the sole.

* * * * *